US009833665B2

(12) United States Patent
Madson

(10) Patent No.: US 9,833,665 B2
(45) Date of Patent: Dec. 5, 2017

(54) GOLF BALL DIMPLE BASED ON WITCH OF AGNESI CURVE

(75) Inventor: Michael R. Madson, Pawtucket, RI (US)

(73) Assignee: Acushnet Company, Fairhaven, MA (US)

( * ) Notice: Subject to any disclaimer, the term of this patent is extended or adjusted under 35 U.S.C. 154(b) by 1536 days.

(21) Appl. No.: 12/945,144

(22) Filed: Nov. 12, 2010

(65) Prior Publication Data

US 2012/0122613 A1 May 17, 2012

(51) Int. Cl.
*A63B 37/00* (2006.01)

(52) U.S. Cl.
CPC ..... *A63B 37/0017* (2013.01); *A63B 37/002* (2013.01); *A63B 37/0012* (2013.01)

(58) Field of Classification Search
None
See application file for complete search history.

(56) References Cited

U.S. PATENT DOCUMENTS

| | | | | |
|---|---|---|---|---|
| 4,681,323 | A * | 7/1987 | Alaki et al. | 473/384 |
| 5,653,648 | A | 8/1997 | Thurman | |
| 6,331,150 | B1 | 12/2001 | Ogg | |
| 6,346,053 | B1 * | 2/2002 | Inoue et al. | 473/378 |
| 6,454,668 | B2 * | 9/2002 | Kasashima et al. | 473/378 |
| 6,558,274 | B1 | 5/2003 | Shimosaka | |
| 6,796,912 | B2 | 9/2004 | Dalton et al. | |
| 2001/0002373 | A1 * | 5/2001 | Yamagishi et al. | 473/371 |
| 2001/0005700 | A1 * | 6/2001 | Kasashima et al. | 473/378 |
| 2001/0006914 | A1 * | 7/2001 | Ogg | 473/351 |
| 2003/0086055 | A1 * | 5/2003 | Morris et al. | 351/159 |
| 2007/0149322 | A1 * | 6/2007 | Aoyama et al. | 473/378 |
| 2007/0259739 | A1 * | 11/2007 | Kasashima et al. | 473/384 |
| 2009/0221387 | A1 * | 9/2009 | Ohama et al. | 473/383 |
| 2012/0046130 | A1 * | 2/2012 | Fitchett et al. | 473/383 |

* cited by examiner

*Primary Examiner* — John E Simms, Jr.
(74) *Attorney, Agent, or Firm* — Mandi B. Milbank

(57) ABSTRACT

A golf ball having the contour wherein at least one dimple has the cross-section of the dimple surface based on a modified witch of Agnesi curve and defined by the equation in the form of:

$$y(x) = \frac{-C_1 a^3}{x^2 + C_2 a^2} + \frac{C_1 a^3}{\left(\frac{d}{2}\right)^2 + C_2 a^2}$$

wherein:
y is the vertical distance from the dimple apex,
x is the radial distance from the dimple apex,
a is equal to the radius of the circle in the witch of Agnesi,
d is the dimple diameter, and
$C_1$ and $C_2$ are constants that will produce a variety of dimple surfaces from a variety of functions.

8 Claims, 3 Drawing Sheets

Dimple and Ball Profile

Dimple and Ball Profile

Dimple and Ball Profile

Dimple and Ball Profile

GOLF BALL DIMPLE BASED ON WITCH OF AGNESI CURVE

CROSS-REFERENCE TO RELATED APPLICATIONS

The present invention is a substitute specification of co-pending U.S. application Ser. No. 12/945,144 filed Nov. 12, 2010, the disclosure of which is incorporated herein in its entirety.

FIELD OF THE INVENTION

The present invention relates to a golf ball, and more particularly, to the contour of the dimple surface being based on a witch of Agnesi curve.

BACKGROUND OF THE INVENTION

Golf balls were originally made with smooth outer surfaces. In the late nineteenth century, players observed that the gutta-percha golf balls traveled further as they got older and more gouged up. The players then began to roughen the surface of new golf balls with a hammer to increase flight distance. Manufacturers soon caught on and began molding non-smooth outer surfaces on golf balls.

By the mid 1900's, almost every golf ball being made had 336 dimples arranged in an octahedral pattern. Generally, these balls had about 60 percent of their outer surface covered by dimples. Over time, improvements in ball performance were developed by utilizing different dimple patterns. In 1983, for instance, Titleist introduced the TITLEIST 384, which, not surprisingly, had 384 dimples that were arranged in an icosahedral pattern. About 76 percent of its outer surface was covered with dimples. Today, dimpled golf balls travel nearly two times farther than a similar ball without dimples.

The dimples on a golf ball are important in reducing drag and increasing lift. Drag is the air resistance that acts on the golf ball in the opposite direction from the ball flight direction. As the ball travels through the air, the air surrounding the ball has different velocities and, thus, different pressures. The air exerts maximum pressure at the stagnation point on the front of the ball. The air then flows over the sides of the ball and has increased velocity and reduced pressure. At some point it separates from the surface of the ball, leaving a large turbulent flow area called the wake that has low pressure. The difference in the high pressure in front of the ball and the low pressure behind the ball slows the ball down. This is the primary source of drag for a golf ball.

The dimples on the ball create a turbulent boundary layer around the ball, i.e., the air in a thin layer adjacent to the ball flows in a turbulent manner. The turbulence energizes the boundary layer and helps it stay attached further around the ball to reduce the area of the wake. This greatly increases the pressure behind the ball and substantially reduces the drag.

Lift is the upward force on the ball that is created from a difference in pressure on the top of the ball to the bottom of the ball. The difference in pressure is created by a warpage in the air flow resulting from the ball's back spin. Due to the back spin, the top of the ball moves with the air flow, which delays the separation to a point further aft. Conversely, the bottom of the ball moves against the air flow, moving the separation point forward. This asymmetrical separation creates an arch in the flow pattern, requiring the air over the top of the ball to move faster, and thus have lower pressure than the air underneath the ball.

Almost every golf ball manufacturer researches dimple patterns in order to increase the distance traveled by a golf ball. A high degree of dimple coverage is beneficial to flight distance, but only if the dimples are of a reasonable size. Dimple coverage gained by filling spaces with tiny dimples is not very effective, since tiny dimples are not good turbulence generators.

In addition to researching dimple pattern and size, golf ball manufacturers also study the effect of dimple shape, volume, and cross-section on overall flight performance of the ball. In most cases, the cross-sectional profiles of dimples in prior art golf balls are parabolic curves, ellipses, semi-spherical curves, saucer-shaped, a sine curve, a truncated cone, or a flattened trapezoid. One disadvantage of these shapes is that they can sharply intrude into the surface of the ball, which may cause the drag to become greater than the lift. As a result, the ball may not make best use of momentum initially imparted thereto, resulting in an insufficient carry of the ball. Despite all the cross-sectional profiles disclosed in the prior art, there has been no disclosure of a golf ball having dimple profiles based on the witch of Agnesi curve.

SUMMARY OF THE INVENTION

The present invention is directed to defining dimples on a golf ball, wherein at least one cross-section of a dimple is defined by a curve that is based on the witch of Agnesi and defined by the Cartesian equation in the form of:

$$y(x) = \frac{8a^3}{x^2 + 4a^2}$$

wherein:

y is the vertical distance from the dimple apex, x is the radial distance from the dimple apex, and a is equal to the radius of the circle in the witch of Agnesi when located at a position (0, a) on FIG. 1.

An embodiment of the invention provides for a cross-section based on a modified witch of Agnesi curve and defined by the equation in the form of:

$$y(x) = \frac{-C_1 a^3}{x^2 + C_2 a^2} + \frac{C_1 a^3}{\left(\frac{d}{2}\right)^2 + C_2 a^2}$$

wherein:

8 in claim 1 has been replaced by $C_1$ 4 in claim 1 has been replaced by $C_2$ d is the dimple diameter and $-d<x>d$ $C_1$ and $C_2$ are shape constants

BRIEF DESCRIPTION OF THE DRAWINGS

These and other aspects of the present invention may be more fully understood with references to, but not limited by, the following drawings.

DETAILED DESCRIPTION OF THE INVENTION

Figure 1:
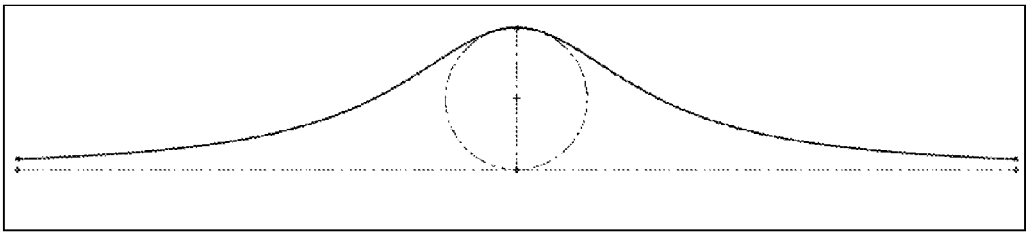
FIG. 1 depicts a typical witch of Agnesi curve.

The present invention is a golf ball which comprises dimples having a cross-section that is based on the curve known as the witch of Agnesi as depicted in FIG. 1.

Figure 2:
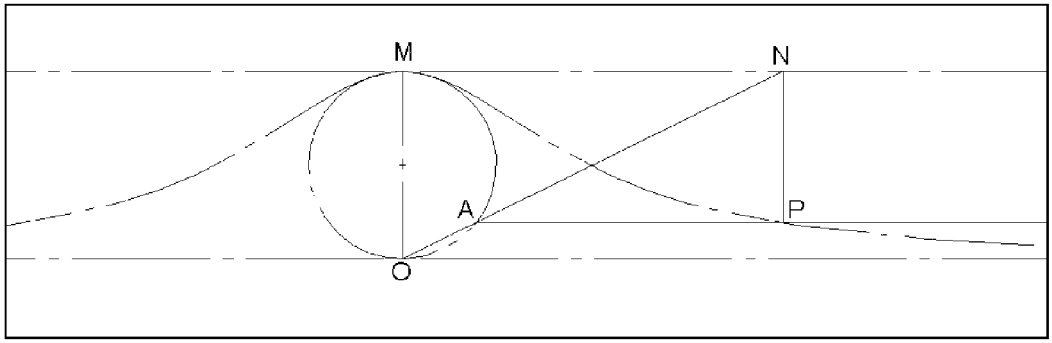
FIG. 2 illustrates a witch of Agnesi curve with labeled points.

The definition of the curve with labeled points is shown on FIG. 2. Starting with a fixed circle, a point O on the circle is chosen. For any other point A on the circle, the secant line OA is drawn. The point M is diametrically opposite O. The line OA intersects the tangent at M at the point N. The line parallel to OM through N, and the line perpendicular to OM through A intersect at P. As the point A is varied, the path of P is the witch. Therein the curve is asymptotic to the line tangent to the fixed circle through the point O. Making a supposition that the point O is the origin, that M is on the positive y-axis and that the radius of the circle is a, then the curve has the following Cartesian equation:

$$y(x) = \frac{8a^3}{x^2 + 4a^2} \qquad \text{Equation 1}$$

Where:

a is equal to the radius of the circle in FIG. 1 that is located at a position O on the horizontal axis (x); and y is the curve as expressed by a mathematical equation.

In order to properly manipulate this curve for the purpose of dimple design, the following changes can be made to adjust the curve.

1) The y values may be made negative for easier definition of the dimple.

2) The chord plane of the dimple represents y=0 on the axis, and is an asymptote for the curve.

3) The "8" in Equation 1 is changed to constant $C_1$ and can be changed for manipulation such as:

$$8 \rightarrow C1 \qquad \text{Equation 2}$$

4) The "4" in Equation 1 is changed to C2 and can be changed for manipulation.

$$4 \rightarrow C2 \qquad \text{Equation 3}$$

5) The axis in the center of the dimple represents x as equal to 0.

6) "y" will only be evaluated within the range of the dimple diameter such that "d" is the dimple diameter and:

$$\frac{-d}{2} \le x \le \frac{d}{2} \qquad \text{Equation 4}$$

7) The curve is then shifted so that it intersects the chord plane at the edges of the dimple.

8) With these adjustments, the equation to define the dimple profile must be continuous and differentiable; the equation for the dimple is as follows:

$$y(x) = \frac{-C_1 a^3}{x^2 + C_2 a^2} + \frac{C_1 a^3}{\left(\frac{d}{2}\right)^2 + C_2 a^2} \qquad \text{Equation 5}$$

where $-d < x < d$

Thus Equation 5 is the curve defined by the Witch of Agnesi and modified to define dimple profiles. This equation defines the profile such that y(0)=0; y(d/2) is equal to the surface depth, and it is the point where the profile meets the surface of the golf ball and defines the edge of a dimple.

In order to maintain an appropriate level of manufacturability as well as preserve the integrity of the curve in the dimple profile:

$$.01 \le a < \frac{d}{2} \qquad \text{Equation 6}$$

The dimple chord volume, $V_C$, for any particular dimple volume can be calculated by using Equation 7:

Equation 7-Dimple Chord Volume $$V_C = \pi \frac{D_c d^2 C_2 - d^2 C_1 a - 8 C_1 C_2 a^3 \ln(2) + 4 C_1 C_2 a^3 \ln(d^2 + 4 C_2 a^2) - 4 C_1 C_2 a^3 \ln(C_2 a^2)}{4 C_2}$$

Where $D_C$ is the chord depth of a particular dimple, calculated as:

$$D_c = \frac{C_1 a}{C_2} - \frac{C_1 a^3}{\left(\frac{d}{2}\right)^2 + C_2 a^2} \qquad \text{Equation 8-Dimple Chord Depth}$$

The dimple volume should relate to its corresponding diameter such that:

$$.0010 \le \frac{V_c}{d^2} \le .0040 \qquad \text{Equation 9}$$

More preferably:

$$.0015 \le \frac{V_c}{d^2} \le .0030 \qquad \text{Equation 10}$$

The curvature at any point x along the dimple profile can be calculated with:

$$\kappa(x) = \frac{8\frac{C_1 a^3 x^2}{(x^2 + C_2 a^2)^3} - 2\frac{C_1 a^3}{(x^2 + C_2 a^2)^2}}{\left[1 + 4\frac{C_1^2 a^6 x^2}{(x^2 + C_2 a^2)^4}\right]^{3/2}} \qquad \text{Equation 11}$$

For optimal performance the dimple should be designed such that the maximum curvature (as an absolute value) at any point in the dimple profile should adhere to the following specifications:

$$|\kappa_{MAX}| \le 200 \qquad \text{Equation 12}$$

More preferably:

$$|\kappa_{MAX}| \le 100 \qquad \text{Equation 13}$$

And most preferably:

$$|\kappa_{MAX}| \le 50 \qquad \text{Equation 14}$$

Using the chord volume ($V_c$), a volume ratio for the dimple can be determined. The volume ratio ($R_v$) is the fractional ratio of the dimple volume divided by the volume of a cylinder defined by a similar radius and depth of dimple. The desired $R_v$ values are as follows:

$$R_V = \frac{V_c}{\pi\left(\frac{d}{2}\right)^2 D_c} \quad \text{Equation 15}$$

The volume ratio must adhere to the following:

$$0.01 \leq R_V \leq 0.50 \quad \text{Equation 16}$$

More preferably:

$$0.15 \leq R_V \leq 0.35 \quad \text{Equation 17}$$

Dimples may be defined with a variation of parameters that will yield variations of dimple profiles, such as:

Example 1

Figure 3:
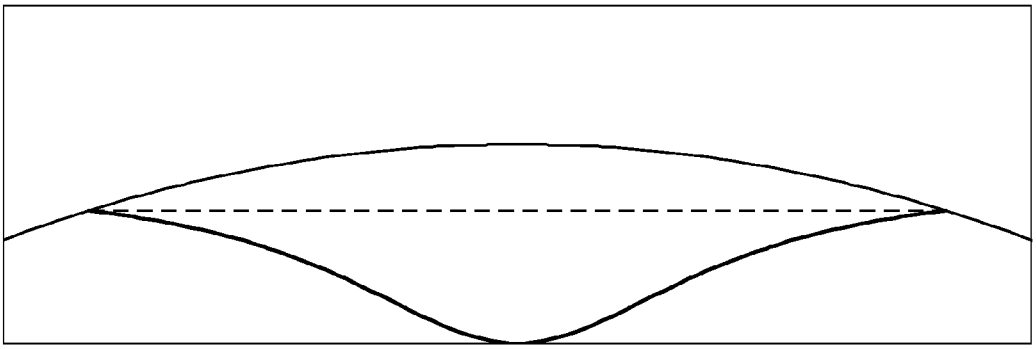
FIG. 3 illustrates a dimple profile based on the parameters of example 1.

If a dimple were defined with the following parameters: d=0.200 inches, $C_1$=1.6, $C_2$=3.1, a=0.0287, then that dimple would resemble the profile shown on FIG. 3 (although not to scale) and produce a golf ball satisfying the design criteria:

$D_c$=0.0118; $|\kappa_{MAX}|$=11.6; $V_c$=9.458×$10^{-5}$;

$$\frac{V_c}{d^2} = .0024;$$

and $R_V$=0.255.

Example 2

Figure 4:
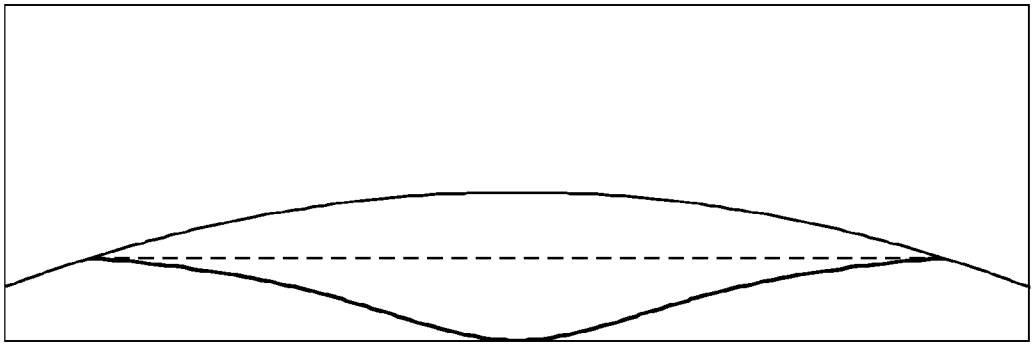
FIG. 4 illustrates a dimple profile based on the parameters of example 2.

In this example $C_1$ is decreased from 1.6 to 1.0, while the other parameters of Example 1 are maintained, which causes the curve to be slightly flattened and subsequently creating a dimple that is a little shallower. The profile of this dimple is shown in FIG. 4 and produces a golf ball satisfying the design criteria:

Dc=0.0074; |κMAX|=7.3; Vc=5.911×$10^5$;

$$\frac{V_c}{d^2} = 0015;$$

and $R_V$=0.255.

Example 3

Figure 5:
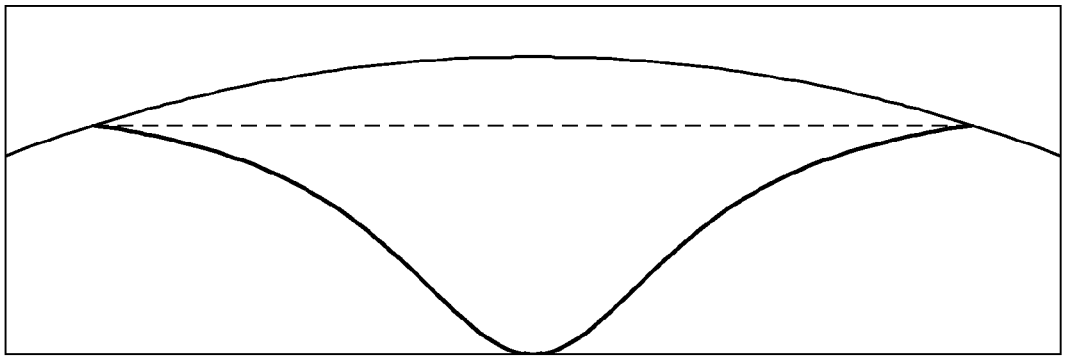
FIG. 5 illustrates a dimple profile based on the parameters of example 3.

Based on the parameters of Example 1, $C_2$ is decreased from 3.1 to 2.0, therein causing the curve to become steeper in profile and thus increasing the dimple depth. The profile thus produced for the dimple would resemble as shown in FIG. 5 and produces a golf ball satisfying the design criteria:

Dc=0.0197; $|\kappa_{MAX}|$=27.9; Vc=1.034×$10^{-4}$;

$$\frac{V_c}{d^2} = .0033;$$

and $R_V$=0.211.

Example 4

Figure 6:
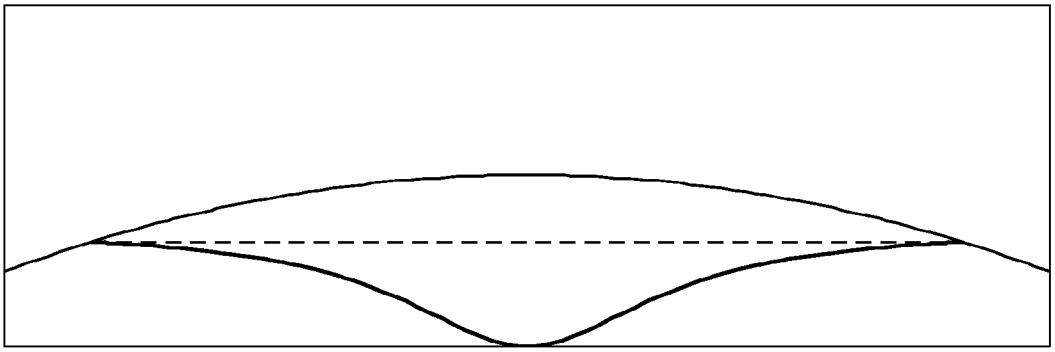
FIG. 6 illustrates a dimple profile based on the parameters of example 4.

This Example illustrates the effect of decreasing a in Example 1, from 0.0287 to 0.020 yet maintaining the other parameters of Example 1. As seen in FIG. 6, the profile of the curve is steeper and the radius is decreased at the bottom of the dimple. The profile produces a golf ball satisfying the design criteria:

Dc=0.0092; $|\kappa_{MAX}|$=16.6; Vc=5.287×$10^5$;

$$\frac{V_c}{d^2} = .0013;$$

and $R_V$=0.183.

The present invention may be used with practically any type of ball construction. For instance, the ball may have a 2-piece design, a double cover or veneer cover construction depending on the type of performance desired of the ball. Examples of these and other types of ball constructions that may be used with the present invention include those described in U.S. Pat. Nos. 5,713,801, 5,803,831, 5,885,172, 5,919,100, 5,965,669, 5,981,654, 5,981,658, and 6,149,535. Different materials also may be used in the construction of the golf balls made with the present invention. For example, the cover of the ball may be made of polyurethane, ionomer resin, balata or any other suitable cover material known to those skilled in the art. Different materials also may be used for forming core and intermediate layers of the ball. After selecting the desired ball construction, the flight performance of the golf ball can be adjusted according to the design, placement, and number of dimples on the ball. As explained above, the use of a variety of dimples, based on a witch of Agnesi curve, provides a relatively effective way to modify the ball flight performance without significantly altering the dimple pattern. Thus, the use of dimples based on a witch of Agnesi curve allows a golf ball designer to select flight characteristics of a golf ball in a similar way that different materials and ball constructions can be selected to achieve a desired performance.

Each dimple of the present invention is part of a dimple pattern selected to achieve a particular desired lift coefficient. Dimple patterns that provide a high percentage of surface coverage are preferred, and are well known in the art. For example, U.S. Pat. Nos. 5,562,552, 5,575,477, 5,957,787, 5,249,804, and 4,925,193 disclose geometric patterns for positioning dimples on a golf ball. Preferably a dimple pattern that provides greater than about 50% surface coverage is selected. Even more preferably, the dimple pattern provides greater than about 70% surface coverage. Once the dimple pattern is selected, several alternative shapes can be tested in a wind tunnel or light gate test range to empirically determine the profile shape that provides the desired lift coefficient at the desired launch velocity. Preferably, the measurement of lift coefficient is performed with the golf ball rotating at typical driver rotation speeds. A preferred spin rate for performing the lift and drag tests is 3,000 rpm.

As discussed above, dimples based on a witch of Agnesi curve may be used to define dimples on any type of golf ball, including golf balls having solid, wound, liquid filled or dual cores, or golf balls having multilayer intermediate layer or cover layer constructions. While different ball construction may be selected for different types of playing conditions, the use of dimples based on a witch of Agnesi curve would allow greater flexibility to ball designers to better customize a golf ball to suit a player.

While the invention has been described in conjunction with specific embodiments, it is evident that numerous alternatives, modifications, and variations will be apparent to those skilled in the art in light of the foregoing description.

What is claimed is:

1. A golf ball having a surface with a plurality of recessed dimples thereon, wherein the cross-section of at least one dimple is a curve defined by the equation:

$$y(x) = \frac{-C_1 a^3}{x^2 + C_2 a^2} + \frac{C_1 a^3}{\left(\frac{d}{2}\right)^2 + C_2 a^2}$$

where the chord plane represents y=0, the center axis of the dimple represents x=0, a is a constant equal to the radius of a circle having a center at x=0 and tangent to the curve at the center of the dimple, $C_1$ and $C_2$ are constants, and d is the dimple diameter; and wherein the ratio between the chord volume, $V_c$, of the dimple profile and the square of the dimple diameter, having a profile as defined $d^2$, is:

$$0.0010 \le \frac{V_c}{d^2} \le 0.0040.$$

2. The golf ball according to claim 1, wherein the ratio between the chord volume, $V_c$, of the dimple profile and the square of the dimple diameter, $d^2$, is:

$$0.0015 \le \frac{V_c}{d^2} \le 0.0030.$$

3. The golf ball according to claim 1, wherein the curvature is unique at every point x when $0 \le x \le d/2$.

4. The golf ball according to claim 3, wherein the maximum curvature as an absolute value at any point in the dimple profile is equal to or less than 200.

5. The golf ball according to claim 3, wherein the maximum curvature as an absolute value at any point in the dimple profile is equal to or less than 100.

6. The golf ball according to claim 3, wherein the maximum curvature as an absolute value at any point in the dimple profile is equal to or less than 50.

7. The golf ball according to claim 3, wherein the volume ratio, $R_V$, is from 0.01 to 0.50, as defined by the equation:

$$R_V = \frac{V_c}{\pi\left(\frac{d}{2}\right)^2 D_c},$$

where $D_c$, is the chord depth.

8. The golf ball according to claim 7, wherein the volume ratio is from 0.15 to 0.35.

* * * * *